United States Patent [19]

Amobi

[11] Patent Number: 4,865,235

[45] Date of Patent: Sep. 12, 1989

[54] SUSPENDER HANGER

[76] Inventor: Frank C. Amobi, 3636 16th St., NW. #A652, Washington, D.C. 20010

[21] Appl. No.: 216,457

[22] Filed: Jul. 7, 1988

[51] Int. Cl.[4] ..... A47G 25/14; A47G 25/48

[52] U.S. Cl. ..... 223/85; 211/89; 211/113; D6/32 D; D6/323

[58] Field of Search ..... 211/89, 106, 113, 32, 211/119; 223/85, 93, DIG. 1; D6/320, 323

[56] References Cited

U.S. PATENT DOCUMENTS 500,632 7/1893 Trout ..... 211/32

2,872,089 2/1959 Shrom ..... 223/93

3,327,912 6/1967 Blair ..... 211/119 X

FOREIGN PATENT DOCUMENTS 6817 of 1905 United Kingdom ..... 211/32

*Primary Examiner*—Robert R. Mackey

*Attorney, Agent, or Firm*—Richard C. Litman

[57] ABSTRACT

A suspender hangar apparatus is disclosed for holding a plurality of suspenders. The hangar includes a mounting block, a lower portion having a clip to grip the suspenders, and an upper portion having two laterally extending arms over which the suspenders are draped.

4 Claims, 3 Drawing Sheets

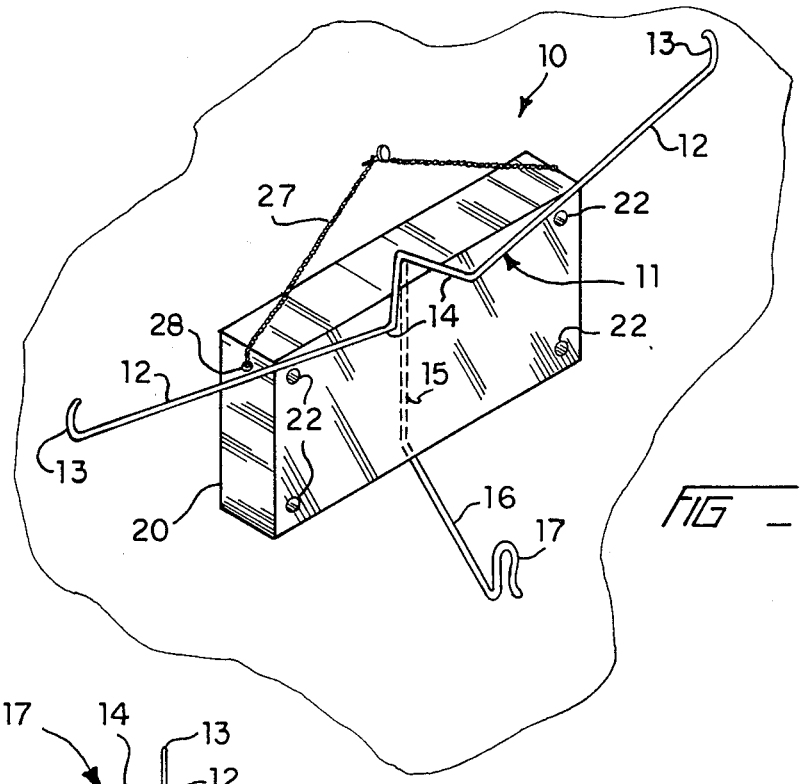
FIG _ 1
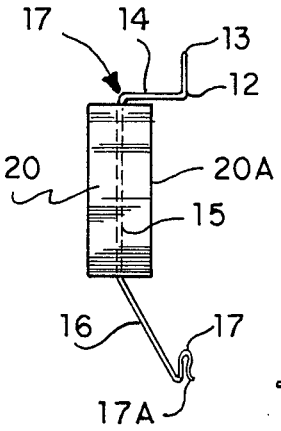
FIG _ 2
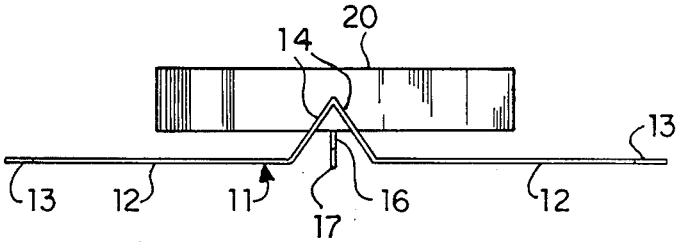
FIG _ 4
FIG _ 3
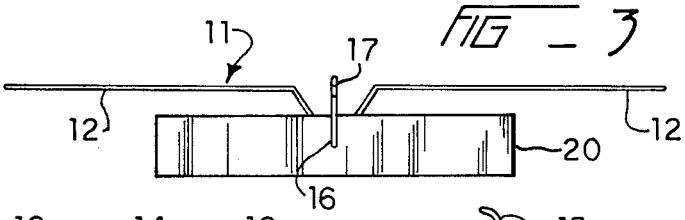
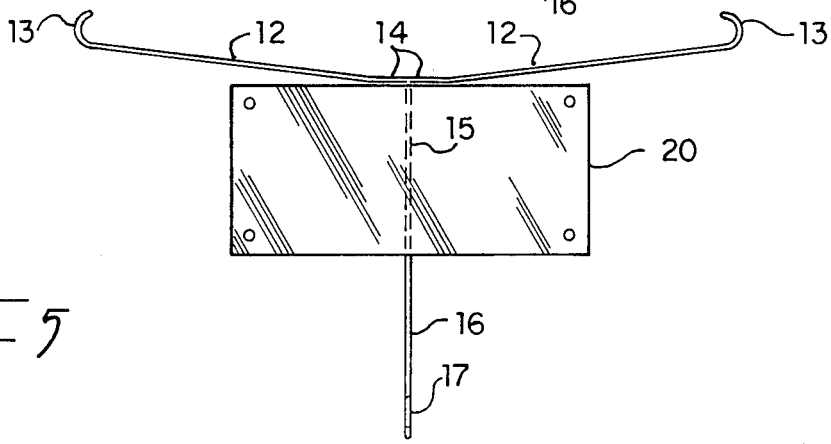
FIG _ 5

SUSPENDER HANGER

BACKGROUND OF INVENTION

There exists a need for a convenient apparatus for storing suspenders, so that the suspenders do not become tangled or knotted. The invention relates to a construction for a suspender hangar which securely holds suspenders in a compact storage area, and simultaneously permits arrangement of the suspenders on the hangar to allow each set of suspenders to be visually identified for selection.

FIELD OF INVENTION

The invention relates to a suspender hangar, and more particularly, the invention is directed to an improved wall mountable hangar apparatus for holding securely a plurality of suspenders in a compact space.

The invention further relates to an improved retaining apparatus for the suspenders which holds the suspenders securely in place.

The invention further is directed to providing a suspender hangar which allows the suspenders to be arranged over the hangar so that they may be arranged adjacent to one another. The device provides for each of the suspenders to be visibly displayed, affording the user with a convenient and ready selection of the appropriate color or suspender.

The invention can be used for a variety of suspenders, including elastic, non-elastic, button and clip type. The only requirement for secure holding of the suspenders is that the suspenders cross or meet in the back. The invention will work equally well with suspenders that criss-cross and suspenders which meet into a single back strap. The method of construction of the device is more fully described herein.

DESCRIPTION OF THE PRIOR ART

Various prior art clothing hangars and the like, as well as their apparatuses and the methods of their construction in general, are known and are found to be exemplary of the U.S. prior art.

U.S. Pat. No. 575,480 to Feldman discloses a clothes drying apparatus used to stretch articles, for the purpose of drying or bleaching, where the article is drawn between two points of support. U.S. Pat. No. 1,229,575 to Bowers discloses a hangar with movable gripping members to secure clothing for drying. U.S. Pat. No. 1,575,270 to Jankowsky discloses a support structure for various types of clothing. The invention has a notched brace attachable to a wall. U.S. Pat. No. 2,447,204 to Piotrowski teaches a decorative garment hangar designed to maintain the shape of a garment and lock it in place. U.S. Pat. No. 4,706,347 to Lindsay discloses a hangar comprising a clip device having two gripper arms that pivot to open and close and a tongue that locks the arms closed. The tongue, when depressed, locks the clothing in place.

These patents or known prior uses teach and disclose various types of hangars for clothing and the like of sorts and of various manufactures, as well as methods of their construction; but none of them, whether taken singly or in combination, disclose the specific details of the combination of the invention in such a way as to bear upon the claims of the present invention.

SUMMARY OF THE INVENTION

An object, advantage, and feature of the invention is to provide a novel suspender hangar that is convenient and efficient in use, and lends itself to the secure holding and displaying of suspenders.

Another object of the invention is further directed to a device for providing for the easy storage of a plurality of suspenders in a wall mounted device, while the suspenders are held securely in place, and are easily attached or removed form the hangar.

Another object of the invention is to provide a novel and improved construction of a fastener for securing the suspenders to the hangar, to wit, the employment of a clip which engages the crossing point at the back of the suspenders.

Another object of the invention is to provide a novel and improved method of construction of a pair of arms for supporting the suspenders, whereby the arms are angled and spread, allowing for the suspenders to be draped adjacent to one another over the arms, so that all of the suspenders may be viewed simultaneously. This is a substantial improvement over existing practices which provides secure holding support, while affording visual identification and easy selection of the desired color or type of suspender.

Still another object of the invention is to provide an improved suspender hangar comprising a mounting block, and a unitary bent wire hangar forming a pair of laterally extending arms and a bottom bracket which supports a clip for securing the suspenders.

These, together with other objects and advantages of the invention reside in the details of the process and the operation thereof, as is more fully hereinafter described and claimed. References are made to drawings forming a part hereof, wherein like numerals refer to like parts throughout.

DESCRIPTION OF THE SEVERAL VIEWS OF THE DRAWINGS

FIG. 1 is a perspective view of a suspender hangar according to a preferred embodiment and best mode of the present invention.

FIG. 2 is a top view of the suspender hangar, according to the preferred embodiment and best mode of the present invention.

FIG. 3 is a bottom view of the suspender hangar, according to the preferred embodiment and best mode of the present invention.

FIG. 4 is a side elevation view of the suspender hangar, according to the preferred embodiment and best mode of the present invention.

FIG. 5 is a front elevation view of the suspender hangar, according to the preferred embodiment and best mode of the present invention.

DESCRIPTION OF THE PREFERRED EMBODIMENTS OF THE INVENTION

Figure 6:
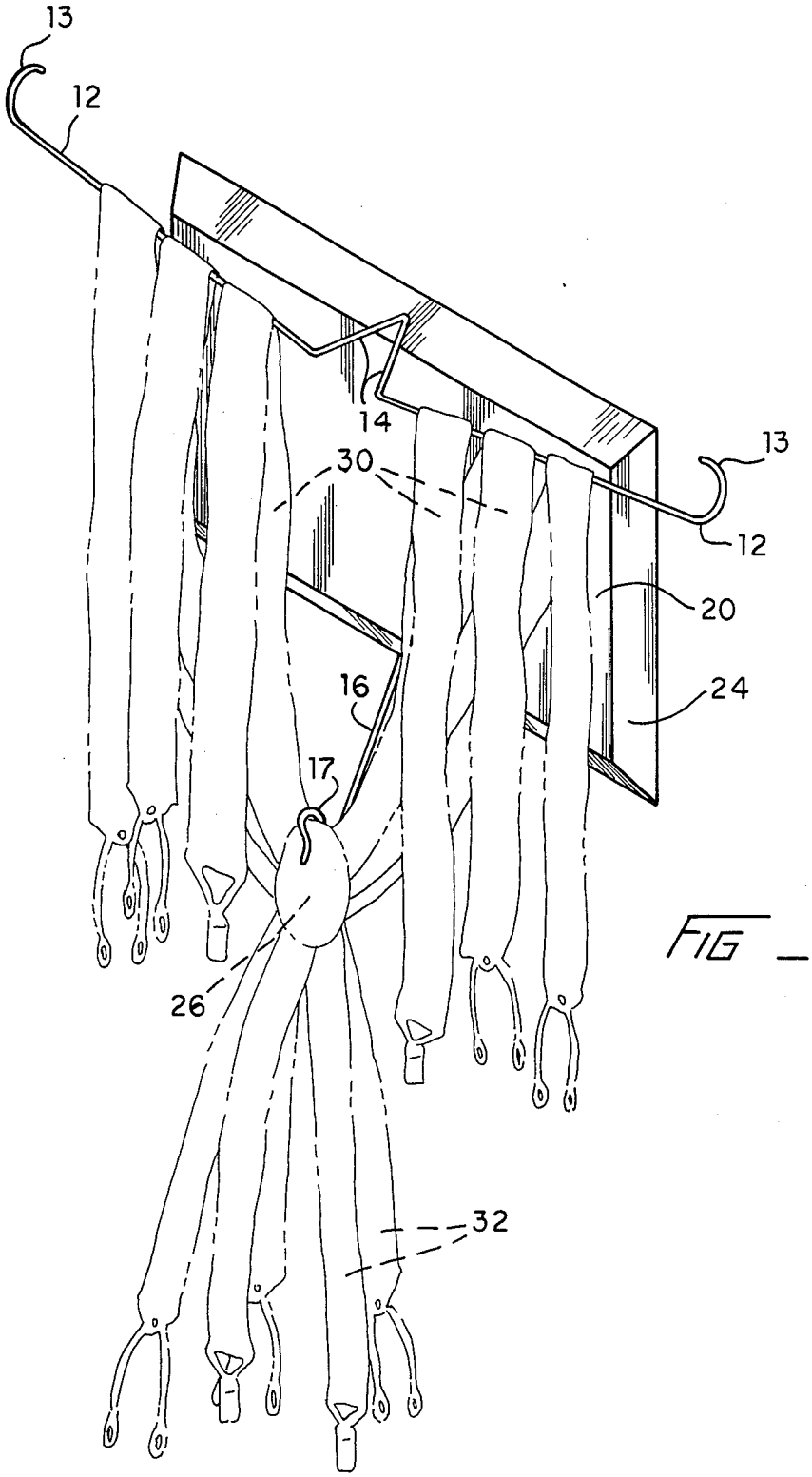
FIGS. 6 and 7 are perspective views of a suspender hangar in use, according to an alternative embodiment of the present invention.

Referring now to the drawings, there is shown in FIG. 1 a suspender hangar according to the present invention, generally designated 10. The suspender hanger comprises a mounting block 20, and a one-piece three point support wire, generally designated 11. The mounting block 20 may be provided with a number of mounting holes 22 and other suitable means for attaching the mounting block to a wall or other vertical surface. For example, there is shown in FIG. 1 an alternate method for affixing the mounting block 20 to a vertical surface, which includes a chain or leather strap 27 attached by fasterners 28 (one shown) to the sides of he mounting block 20. The mounting block 20 also includes a vertical passage therethrough, which surrounds and supports the medial portion 15 of the support wire 11.

The lower portion 16 of support wire 11 projects downward and slightly forward from the front surface 20*a* of mounting block 10, and terminates in a downwardly directed spring clip 17 formed as an integral portion of the support wire lower portion 16. This construction will be seen to result in the formation of a downwardly facing clip bite 17*a* that extends transversely of the spring wire lower portion 16 or, extends in a plane parallel to the mounting block front surface 20*a*. The forward and downward inclination of the lower portion 16 provides clearance between the suspenders and both the wall or vertical surface and the mounting block front surface 20*a*. The integral clip 17 is spring loaded to frictionally engage the cross-member 26 of one or more suspenders, thereby holding the suspenders securely on the hangar.

The upper portion of spring wire 11 is bifurcated into two laterally extending arms 12. The inner portion 14 of the arms 12 is angled forward, so that the arms 12 are in a vertical plane forward of the mounting block front surface 20*a* as shown, for example in FIG. 4 to provide clearance between the suspenders draped over arms 12 and the block and wall or vertical surface. Arms 12 are elongated to receive a plurality of suspenders draped side by side over the arms 12. The arms 12 are angled slightly upward from horizontal to facilitate the draping of the suspenders in a side by side fashion. Arms 12 include proximal and distal ends. The distal ends terminate in upwardly curving hooks 13, to prevent suspenders from slipping over the ends of arms 12.

Figure 7:
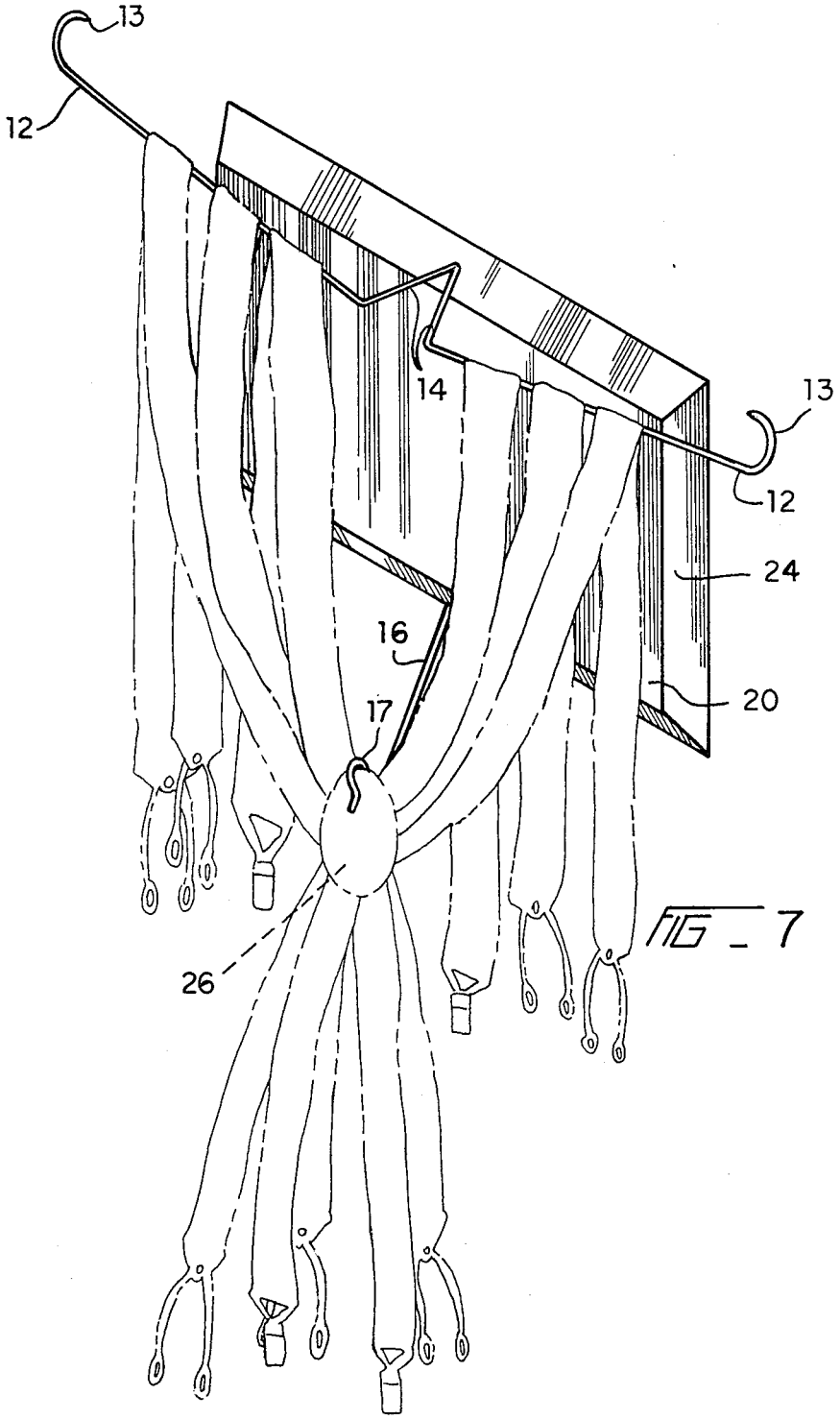

FIGS. 2, 3, 4, and 5 show further views of the preferred embodiment of the invention. FIGS. 6 and 7 show perspective views of a second embodiment of the invention in use holding suspenders. The second embodiment features a mounting block 20 having beveled edged 24. As shown, the forward parts of the suspenders are draped over arms 12, and are secured in place by clip 17, which grips the cross-member 26 on the back of the suspenders. As shown in FIGS. 6 and 7, the suspenders may be draped over the arms 12 in either direction. The construction of the invention allows the suspenders to be stored in a compact fashion near the wall or vertical surface without touching it. The inherent construction of suspenders will be understood to include front/shoulder straps 30 which are relatively long and adapted to extend from a wearer's front waistband, over their shoulders nd terminate or cross at the cross-member 26 located in the middle of the wearer's back. From the cross-member 26, substantially shorter rear straps 32 extend to the rear waistband. Accordingly, it follows that the much greater length of the front/shoulder straps 30 permits the draping and initial support of the suspenders upon the two lateral extension arms 12 and thereafter allows one to push the suspender cross-member 26 upwardly into its engagement within the spring clip 17. Further, the invention allows each of the suspenders to be viewed for easy identification and selection. From the above, it will be apparent that the present invention is easily manufactured because of its structural simplicity and readily lends itself to use in a variety of applications.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

I claim:

1. A hanger for suspendera having two front/shoulder straps crossing at a cross-member with relatively shorter rear straps extending from the cross-member, comprising a mounting block having a front surface and adapted for mounting upon a vertical surface, said mounting block having a hole therethrough;

a support wire of spring wire including a substantially vertically disposed medial segment extending through said mounting block hole, said support wire including a bifurcated upper segment including a pair of lateraly extending arms adapted to permit the draping of the front/shoulder straps of the suspenders over said arms, and a lower segment extending from said medial segment downwardly and forwardly from said mounting block, said lower segment terminating in a downwardly directed spring clip integrally formed from said spring wire, and said spring clip defining a downwardly facing bite extending in a plane parallel to said mounting block front surface and adapted to frictionally and releasably grasp the cross-member of the suspenders as the cross-member is moved upwardly into said spring clip bite.

2. A suspender hangar according to claim 1, wherein; said laterally extending arms are angled upward from horizontal to permit the front/shoulder straps of a plurality of suspenders to be draped side by side over said laterally extending arms.

3. A suspender hangar according to claim 1 wherein; said laterally extending arms include proximal and distal ends, said distal ends terminating in an upwardly curved portion adapted to prevent the front/shoulder straps of suspenders from sliding off said distal ends of said laterally extending arms.

4. A suspender hanger according to claim 3 wherein; said proximal ends of said laterally extending arms comprise forwardly disposed portions with said laterally extending arms disposed in a vertical plane forward of said mounting block front surface whereby, said arms and front/shoulder straps of suspenders draped thereover are provided clearance from said mounting block.

* * * * *